US010378115B2

(12) United States Patent
Daeschler et al.

(10) Patent No.: US 10,378,115 B2
(45) Date of Patent: Aug. 13, 2019

(54) ECONOMIC SECONDARY DESCALING

(75) Inventors: Valerie Daeschler, Marly (FR); Jean-Luc Borean, Florange (FR); Nathalie Mikler, Metz (FR); Gilles Dussart, Istres (FR); Sylvain Mialot, Martigues (FR); Patrice Matet, Istres (FR)

(73) Assignee: ArcelorMittal France, Saint Denis (FR)

( * ) Notice: Subject to any disclaimer, the term of this patent is extended or adjusted under 35 U.S.C. 154(b) by 18 days.

(21) Appl. No.: 12/674,165

(22) PCT Filed: Aug. 20, 2008

(86) PCT No.: PCT/FR2008/001200

§ 371 (c)(1),
(2), (4) Date: Mar. 9, 2011

(87) PCT Pub. No.: WO2009/056712

PCT Pub. Date: May 7, 2009

(65) Prior Publication Data

US 2011/0146706 A1 Jun. 23, 2011

(30) Foreign Application Priority Data

Aug. 21, 2007 (EP) ..... 07291027

(51) Int. Cl.

| | |
|---|---|
| ***B08B 3/02*** | (2006.01) |
| ***C23G 3/02*** | (2006.01) |
| ***B21B 45/08*** | (2006.01) |

(52) U.S. Cl.

CPC ..... *C23G 3/023* (2013.01); *B08B 3/022* (2013.01); *B21B 45/08* (2013.01)

(58) Field of Classification Search

CPC ..... B08B 3/022; B21B 45/08; C23G 3/023
USPC ..... 134/2, 15, 122 R, 134, 198
See application file for complete search history.

(56) References Cited

U.S. PATENT DOCUMENTS

| | | | | |
|---|---|---|---|---|
| 3,054,162 | A | 9/1962 | Amtmann | |
| 3,174,491 | A | 3/1965 | Faler | |
| 3,495,613 | A | 2/1970 | Herold | |
| 3,779,054 | A | 12/1973 | Greenberger | |
| 4,507,949 | A * | 4/1985 | Killilea | 72/201 |
| 4,617,815 | A | 10/1986 | Greenberger | |
| 4,793,168 | A | 12/1988 | Kimura | |
| 5,388,602 | A | 2/1995 | Coassin et al. | |
| 5,505,786 | A | 4/1996 | Cole et al. | |
| 5,853,503 | A | 12/1998 | Seto et al. | |
| 6,210,501 | B1 | 4/2001 | Okano et al. | |
| 6,257,034 | B1 | 7/2001 | Fukumori et al. | |
| 6,385,832 | B1 | 5/2002 | Grafe et al. | |
| 6,582,586 | B1 | 6/2003 | Akashi et al. | |
| 2004/0069034 | A1 | 4/2004 | Seidel | |
| 2004/0251324 | A1 | 12/2004 | Volkel et al. | |
| 2004/0261206 | A1 * | 12/2004 | Ehls et al. | 15/77 |

FOREIGN PATENT DOCUMENTS

| | | | |
|---|---|---|---|
| EP | 0 241 919 | | 10/1987 |
| EP | 0 586 823 | | 3/1994 |
| EP | 1 034 857 | | 9/2000 |
| EP | 1 072 695 | | 1/2001 |
| FR | 2 174 266 | | 10/1973 |
| FR | 2 575 092 | | 6/1986 |
| JP | 57 103731 | | 6/1982 |
| JP | 59 76615 | | 5/1984 |
| JP | 60 61114 | | 4/1985 |
| JP | S60184409 | A | 9/1985 |
| JP | 61 269925 | | 11/1986 |
| JP | 63 183714 | | 7/1988 |
| JP | H05177241 | A | 7/1993 |
| JP | 7 171610 | | 7/1995 |
| JP | 8 90052 | | 4/1996 |
| JP | 9 276925 | | 10/1997 |
| JP | 10 128425 | | 5/1998 |
| JP | 11 47820 | | 2/1999 |
| JP | 11047820 | A * | 2/1999 |
| JP | 2002028713 | A | 1/2002 |
| JP | 2005528216 | A | 9/2005 |

OTHER PUBLICATIONS

Machine translation of JP11-047820 to Ichinose et al., Feb. 23, 1999.*

Abstract: JP-59076615; Kitamura et al. (Year: 1984).*

* cited by examiner

*Primary Examiner* — Mikhail Kornakov
*Assistant Examiner* — Natasha N Campbell
(74) *Attorney, Agent, or Firm* — Davidson, Davidson & Kappel, LLC

(57) ABSTRACT

A process for secondary descaling of running metal strips, especially made of steel, during hot-rolling by-spraying water onto the surface of the running metal strips with spray rails having nozzles supplied with pressurized water, wherein the nozzles are supplied at a hydraulic pressure of from 3 to 30 bar, and wherein the nozzles are regulated so that heat flux density extracted from the strip (HF) resulting from the cooling of its surface by the sprayed water is between 6.5 and 20 $MW/m^2$ for a strip temperature between 900 and 1100° C.

21 Claims, 1 Drawing Sheet

ECONOMIC SECONDARY DESCALING

Figure 1:
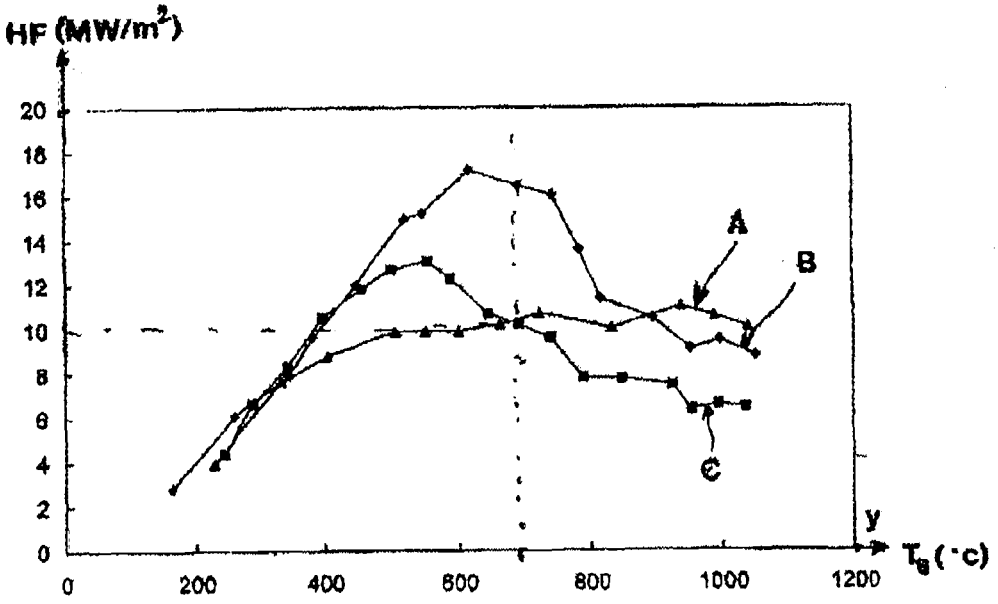

This application is a National Stage of PCT/FR08/001200 filed Aug. 20, 2008 and claims the benefit of EP 07291027.6 filed Aug. 21, 2007.

The present invention relates to the operation of descaling a running metal strip, especially made of steel, during the hot rolling, before said strip enters the roughing or finishing stands of the rolling mill train.

It is recalled that this operation is more commonly known as "secondary descaling" as opposed to "primary" descaling which is carried out on the steel slabs on exiting the reheating furnace before the rolling operation.

It is also recalled that the secondary descaling of steel strips aims to rid the surface of the strip of scale, known as secondary scale, which is formed by rapid reoxidation of the hot metal during the time that the strip is in the open air after its primary descaling on exiting the furnace. It therefore takes place twice during the rolling operation, firstly before the strip enters the rougher, then before it enters into the finisher of the rolling mill train. For the sake of simplicity, reference will be made in what follows solely to the case of the secondary descaling at the entry to the finisher, it being understood that what is said in this regard applies, for the most part, also to the secondary descaling at the entry to the rougher.

The secondary scale is generally present in the form of an adherent layer of metal oxides, conventionally between 50 and 100 μm in thickness, and rather irregular in appearance. The secondary descaling is successful when it provides, at the entry to the finisher, a steel strip comprising, at the surface, a uniform layer of residual scale having a thickness of barely 20 to 30 μm or not much more in order to avoid oxide incrustations on the rolling rolls.

In order to do this, the descaling operation consists schematically in impacting the surface of the running strip with powerful jets of water delivered by spray rails placed a short distance away and equipped with injection nozzles that are fed at high pressure, conventionally above 130-150 bar, or even more than 200 bar in certain cases. The aim is thus to combine a thermal effect (the surface temperature of the strip, around 1100° C. at the entry to the descaling system, drops almost instantaneously to close to 600° C.) with a mechanical effect due to the large amount of movement of the water jets on impact in order to crack the scale and to remove it from the surface via a driving effect. This operation conventionally takes place in a descaling box, having a length of 1 to 2 m approximately, placed at about 5 m upstream of the finishing stands, through which the fast straight running steel strip passes, and which houses the upper and lower spray rails equipped with nozzles that are inclined counter-currently by ten or so degrees.

Although a vital link in any steel production chain that incorporates a hot phase (unless it is desired to place the entire rolling mill train under a non-oxidizing atmosphere which can obviously hardly be envisaged), the secondary descaling remains an expensive operation, not because of the large amounts of water that it involves (the water used is recycled) but because of the high-pressure hydraulic equipment which it uses, and with regard to which it is advisable to consider the possibilities of reducing the costs thereof, particularly in terms of maintenance of the pumps and circuits, and of electricity consumption.

The objective of the invention is to provide an immediately operational response to the question of reducing the costs of the secondary descaling operation, that is to say a response compatible with simply rearranging the existing equipment, and therefore without necessarily involving reinstallation of complete new secondary descaling equipment.

For this purpose, one subject of the invention is a process for the secondary descaling of running metal strips, especially made of steel, during the hot-rolling thereof, by spraying water onto the surface thereof using spray rails having nozzles supplied with pressurized water, characterized in that the nozzles are supplied at low hydraulic pressure, not exceeding 30 bar (and preferably below 10 bar, but without going below around 3 bar), and in that for the purpose of providing a thermal effect of the water sprayed onto the surface to be descaled quantitatively similar to the thermal effect obtained with the usual known method of secondary descaling at high pressure (i.e. a cooling of the strip which reduces the temperature of its oxidized surface to approximately 600° C.), said nozzles are sized so that they deliver a surface flow rate of water onto the strip similar to the surface flow rate of water delivered by said high-pressure method.

Preferably, the surface flow rate of water is greater than 2500 l/min/m$^2$ and advantageously is 7500 l/min/m$^2$.

The invention also relates to a process for the secondary descaling of running metal strips, especially made of steel, during the hot-rolling thereof, by spraying water onto the surface thereof using spray rails having nozzles supplied with pressurized water, characterized in that the nozzles are supplied at low hydraulic pressure, not exceeding 30 bar, and in that for the purpose of providing a thermal effect of the water sprayed onto the surface to be descaled quantitatively similar to the thermal effect obtained with the usual known method of secondary descaling at high pressure, said nozzles are regulated so that the heat flux density extracted from the strip (HF) resulting from the cooling of its surface by the sprayed water is similar to that achieved with said known high-pressure practice.

In this case, the heat flux density extracted from the strip (HF) is between 6.5 and 20 MW/m$^2$ for a strip temperature between 900 and 1100° C.

Advantageously, the heat flux density is between 10 and 11 MW/m$^2$ for a strip temperature between 900 and 1100° C.

The process according to the invention may also comprise various features, taken alone or in combination:

- the nozzles are supplied with a hydraulic pressure of less than 10 bar, without however dropping below 3 bar;
- the process of the invention is carried out upstream of the finishing stands of a steel strip hot-rolling mill train; and
- the process of the invention is carried out upstream of the roughing stands of a steel strip hot-rolling mill train.

Finally, the invention also relates to equipment for the secondary descaling of running metal strips, especially steel strips, comprising spray rails provided with nozzles for spraying water onto the surface of the strip, characterized in that it includes a "low pressure" unit for supplying said nozzles of the spray rails with water.

As will no doubt have already been understood, the invention rests on the discovery that it is much more the thermal effect of the jets of water on the cooling of the oxide crust which acts in favor of the secondary descaling than their mechanical effect on the fragmentation of this oxide crust on the surface of the strip, or, in other words, than the "high-pressure cleaning" effect of the powerful jets on the impact thereof, as had hitherto been thought.

In order to characterize this similarity of thermal effects between the process of the invention and the conventional high-pressure process, mention may be made either of surface flow rate of water, it being understood that this flow rate must be regulated depending on the temperature of the strip at the entry to the descaling system, or of heat flux density extracted from the strip which integrates both the parameters of strip temperature and of surface flow rate of water. But whether it is one or the other manner of expressing and characterizing the process, it is the same basic consideration, namely the use of low pressure while preserving the thermal effect generated by the use of high-pressure jets.

Upstream of the finishing stands and upstream of the roughing stands, the success of the secondary descaling is in fact found to be directly and almost solely linked to the thermal efficiency of the cooling of the oxide layers to be removed, therefore independently of the supply pressure of the nozzles of the spray rails. In other words, at equal thermal efficiency, the quality of the secondary descaling obtained will be the same, whether the descaling is carried out with high-pressure jets or not.

It is emphasized, in order to avoid any confusion, that the expressions used here, "thermal effect of the cooling" and "thermal efficiency", are equivalent. They express the fact that, during the brief residence time of the strip in the descaling box (of the order of barely a second), it is a question of ensuring a drop in the temperature of the oxide layer to around 600° C., regardless of its temperature at the entry to this box. It is known that the underlying physical quantity, which ordinarily can be measured on a rolling mill train, is the heat flux density extracted.

Hence, the replacement of the customary powerful jets (100 bar and above) with "low-pressure" jets (less than 30 bar) is sufficient to ensure the thermal contraction of the oxide crust, which contraction will result in delaminations of this crust, finished off by the energy of the jets which, although modest, is more than enough here for the task of then making the removal of the scale easy by simple sweeping and entrainment action using water streaming across the surface.

These cascade effects are obtained with "low-pressure" jets in accordance with the invention if, as has already been said, they provide the same level of cooling of the oxide layer on the strip as with the "high-pressure" jets, which level of cooling will in fact be achieved by very simply maintaining the surface flow rate of cooling water onto the strip.

Thus, the replacement of the customary "high-pressure" water supply with a "low-pressure" supply becomes a solution that can be immediately applied industrially in order to thus benefit from a considerable economic advantage without compromising the descaling quality.

Figure 2:
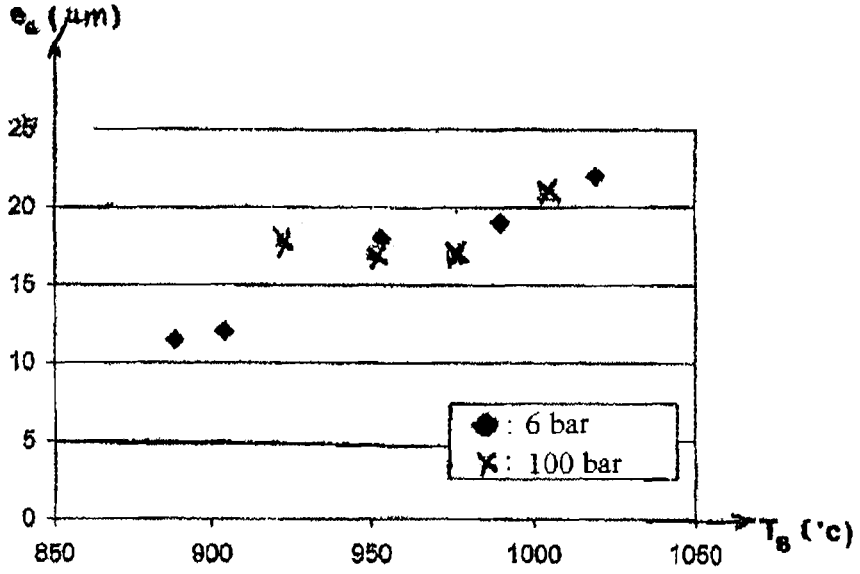

The invention will be better understood and other aspects and advantages will appear more clearly in light of the description which follows, given with reference to the appended single page of figures in which:

FIG. 1 is a plot of experimentally-derived curves, known as boiling curves, that show, as a function of the surface temperature of the strip, the comparative thermal efficiency of a secondary descaling before the entry to the finisher carried out with different hydraulic pressures of sprayed water. This thermal efficiency is expressed quantitatively on the y-axis by the extracted surface heat flux density (HF), given in MW/m$^2$ of surface of metal strip; and FIG. 2 shows the efficiency of this secondary descaling, in terms of residual thickness of the layer of scale in micrometers ($e_c$) in a range of surface temperatures of the descaled steel strip (900-1050° C.) deliberately chosen in accordance with the inlet temperatures in the finishing stands.

In FIG. 1, the reference curve is curve A. This curve A results from a conventional secondary descaling carried out using powerful water jets from nozzles supplied at 130 bar of pressure. The other two curves B and C are representative of "low-pressure" jets of 8 bar each, one (curve B) resulting from tests carried out with a surface flow rate of spraying water equal to that of the "high-pressure" jet curve A, namely 7500 l/min/m$^2$, the other, curve C, resulting from tests carried out with a substantially lower surface flow rate: 1500 l/min/m$^2$.

It is important to again remember here that the criterion for regulating a successful "low-pressure" secondary descaling operation, in accordance with the invention, lies in maintaining, in the oxide layer, a thermal effect similar to that carried out conventionally with "high-pressure" jets (curve A). This should result, in the end, in a drop in the temperature of the blank of 20 to 100° C. (depending on the grade of steel to be rolled) between its entering the spray box (conventionally 1100° C. approximately for a carbon steel for example) and its entering the finishing stands of the rolling mill (conventionally 1030° C. approximately).

In order to achieve this, considering the short residence time of the strip under the spray rails (of the order of a second), it is therefore advisable to provide, under these rails, a cooling which suddenly makes the surface of the strip drop to approximately 600° C., in order, on the one hand, that the cooling rate of the oxide crust is high enough so that the oxides/metal differential thermal contraction which results therefrom succeeds in detaching this crust by fragmenting it as much as possible and, on the other hand, that the inevitable subsequent heat input from the core of the strip towards the surface makes the surface achieve the temperature that is desired at the entry to the finishing stands.

This thermal effect, which is therefore expressed by a high rate of momentary cooling of the surface of the strip (of several hundreds of degrees/sec) has been expressed, for the parameterization of the three curves from the graph, by a physical quantity that is conventionally accessible from the measurement, namely the heat flux density extracted from the product, during rolling, by the sprayed water (abbreviated to Heat Flux or HF), which quantity is expressed in MW/m$^2$. Indeed, this characteristic quantity is particularly suitable for sizing a descaling installation, since it is correlated to the flow rate of cooling water per m$^2$ of strip (the surface flow rate of water) which, itself, is a parameter which may be easily obtained from the definition of the descaling operation: schematically, a surface flow rate of cooling water corresponds to a value of HF.

Thus, as can be seen, the HF of the reference "high-pressure" descaling (curve A) has been kept constant at around 10 MW/m$^2$ throughout the spraying operation (surface temperature ranging from 1100 to 600° C.). Those of the "low-pressure" descaling operations according to the invention have been maintained respectively, in the same range of temperatures, between 10 and 18 MW/m$^2$ in the experimental case representative of curve B and between 6 and 10 MW/m$^2$ in the case of curve C.

It will be noted that the value HF is in fact calculated from data specific to each descaling equipment, which data are, to mention only the most important, the temperature of the cooling water (here 20° C. for all the tests), the type of spray nozzles, the outlet pressure of the water from these nozzles, the distance separating the nozzle tip from the surface of the strip to be descaled, and also the opening angle of the jet at the outlet of the nozzle.

It will be observed that the general appearance is the same for curve B and curve C: a common rise until a strip surface temperature of approximately 450° C., followed by a hump, the maximum of which is between 550 and 600° C. for both curves, but with differentiated intensities this time. Then, a decrease takes place almost in parallel between the two curves until 1100° C., which is the common inlet temperature of the test strips entering the descaling boxes.

It will be noted that it is precisely at that level of the temperature range (1100 to 900° C. more broadly) that the industrial advantage of the process according to the invention should especially be appreciated since almost all the hot-rolling mill trains for steel strips operate with strip temperatures at the entry to the finishing stands that lie between 900 and 1100° C.

Indeed, it is precisely in this temperature range that an almost equivalent descaling quality is observed between the high-pressure reference curve A and the low-pressure curve B, the equivalence to be correlated of course to that of the HF values on the graph (between 10 and 11 $MW/m^2$). On the other hand, compared to those values, the low-pressure curve C, which displays a substantially lower HF (slightly less than 7 $MW/m^2$) expresses a correlatively worse descaling quality.

Indeed, as is shown, by the tests carried out in an industrial pilot plant and recorded in FIG. 2, it is in this temperature range that it is observed that a thin residual layer of scale, that barely exceeds 23 μm in thickness, is obtained whether an LP configuration at 6 bar or HP configuration at 100 bar is used, thus reflecting an almost identical descaling quality for both these options.

It is specified that these tests were carried out on an ISF-type low carbon steel strip with a "nozzle-steel strip" distance of 160 mm that was identical in each case, likewise as regards the flow rate of water sprayed per nozzle, namely 110 l/min, again likewise as regards the running speed of the steel strip at 60 m/min and the temperature of the sprayed water (20° C.). The efficiency of the descaling was evaluated (on the y-axis) from the measurement of the thickness of residual scale on the surface of the strip by observation of micrographic cross sections of the descaled product.

More generally, it has been evaluated that the descaling according to the invention may be carried out for a heat flux density extracted from the product between 6.5 and 20 $MW/m^2$ and, when reference is made to the surface flow rate of water, for a flow rate greater than 2500 $l/min/m^2$.

The flux densities expressed above are measured under the rail in the area of impact of the descaling jets.

It is again found here, with supporting figures, that which has already been emphasized previously, namely the importance of working with a thermal efficiency (HF) that is maintained relative to what is the practice conventionally, when moving from a "high-pressure" descaling to a "low-pressure" descaling in accordance with the invention.

The choice of the level of the low pressure to be maintained indeed proves to be of secondary importance compared to maintaining the HF, this being, of course, as long as the pressure is not dropped too low, say around 3-5 bar minimum. Otherwise the required surface flow rates of water, therefore the required levels of HF (of the order of 10 $MW/m^2$) would no longer be able to be achieved, except by multiplying the spray rails, but with the risk nevertheless of no longer being able to ensure the thermal contraction effect of the oxide crust necessary for its detachment from the metal support surface.

Conversely, the economic advantage of working industrially with a "low pressure" which would be located at more than 30 bar suddenly becomes blurred at this pressure level since the equipment necessary therefor are those, or similar to those, which are already used today for "high-pressure" systems.

It will have been understood that the invention could easily be implemented by operating with pumps supplied at low pressure, thus saving energy and reducing maintenance costs, if the conformation of the nozzles is adapted, as required, in order to provide a surface flow rate of water equivalent to that which would have been used in a high-pressure configuration.

The nozzles used for implementing the process of the invention will be positioned at the same distance from the strip as the distance applied during the known high-pressure descaling process.

Other additional advantages will be observed, which are linked to the use of low-pressure rails in place of high-pressure rails in order to achieve the secondary descaling, such as:

- the possibility of splitting the low-cost low-pressure rails. Splitting the rails will make it possible to spray as little as possible, namely the strip to be descaled only and not the entire width of the rolling mill train, which leads to savings in water, a reduction of the weight of water which circulates in a loop and therefore a corresponding reduction in the supplementary energy cost;
- the possibility of using "low-pressure" rails as an actuator for controlling the thermics of the strip as it enters the finisher;
- less wear of the water-spraying nozzles;
- overall reduction in the maintenance costs of the installation (pumps, valves, circuits, etc.).

It goes without saying that the invention cannot be limited to the examples described above, but applies to multiple variants and equivalents. In particular, it is recalled that it relates to any form of secondary descaling, that is to say removal of scale previously formed by high-temperature oxidation of a metal surface in contact with ambient air.

The invention claimed is:

1. A process for secondary descaling of running metal strips during hot-rolling, the process comprising:

spraying water onto a surface of the running metal strips with spray rails having nozzles supplied with pressurized water to descale the surface, wherein all of the nozzles are supplied at a hydraulic pressure of from 3 to 30 bar, and regulating the nozzles so a heat flux density extracted from the strip (HF) resulting from the cooling of the surface by the sprayed water is between 6.5 and 20 $MW/m^2$ for a strip temperature between 900 and 1100° C.

2. The process as claimed in claim 1, wherein the heat flux density is between 10 and 11 $MW/m^2$ for a strip temperature between 900 and 1100° C.

3. The process as claimed in claim 2, wherein said nozzles are regulated so that the nozzles deliver a surface flow rate of water onto the strip at a rate greater than 2500 $l/min/m^2$.

4. The process as claimed in claim 2, wherein the nozzles are supplied with a hydraulic pressure of between 10 bar and 3 bar.

5. The process as claimed in claim 4, which is carried out upstream of finishing stands of a steel strip hot rolling mill train.

6. The process as claimed in claim 5, which is carried out upstream of roughing stands of a steel strip hot-rolling mill train.

7. The process as claimed in claim 5, wherein the running metal strip is a steel strip.

8. The process as claimed in claim 4, wherein the running metal strip is a steel strip.

9. The process as claimed in claim 2, which is carried out upstream of finishing stands of a steel strip hot-rolling mill train.

10. The process as claimed in claim 2, wherein the running metal strip is a steel strip.

11. The process as claimed in claim 1, wherein said nozzles are regulated so that the nozzles deliver a surface flow rate of water onto the strip at a rate greater than 2500 $l/min/m^2$.

12. The process as claimed in claim 11, wherein the surface flow rate of water is 7500 $l/min/m^2$.

13. The process as claimed in claim 12, wherein the nozzles are supplied with a hydraulic pressure between 10 and 3 bar.

14. The process as claimed in claim 1, wherein the nozzles are supplied with a hydraulic pressure of between 10 bar and 3 bar.

15. The process as claimed in claim 14, which is carried out upstream of finishing stands of a steel strip hot rolling mill train.

16. The process as claimed in claim 15, which is carried out upstream of roughing stands of a steel strip hot-rolling mill train.

17. The process as claimed in claim 14, wherein the running metal strip is a steel strip.

18. The process as claimed in claim 1, which is carried out upstream of finishing stands of a steel strip hot-rolling mill train.

19. The process as claimed in claim 18 which is carried out upstream of roughing stands of a steel strip hot-rolling mill train.

20. The process as claimed in claim 1, wherein the running metal strip is a steel strip.

21. The process as claimed in claim 1, wherein the surface of the strip is 600° C. after spraying.

* * * * *